United States Patent [19]

Neiley et al.

[11] Patent Number: 4,896,429

[45] Date of Patent: Jan. 30, 1990

[54] SOLE MEASURING DEVICE

[76] Inventors: Roger Neiley, 11 Pond Crest, Danbury, Conn. 06811; Joseph Campisi, 18 Cobbler La., New Milford, Conn. 06776; Douglas Hammond, 32A Carriage House Dr., Danbury, Conn. 06810

[21] Appl. No.: 238,214

[22] Filed: Aug. 30, 1988

[51] Int. Cl.[4] ..... A43D 1/08; A63C 11/00

[52] U.S. Cl. ..... 33/3 B; 33/3 R; 280/809

[58] Field of Search ..... 33/3 R, 3 B, 650, 3 A, 33/3 C, 6, 143 C; 280/611, 633, 809

[56] References Cited

U.S. PATENT DOCUMENTS

| | | | |
|---|---|---|---|
| 234,205 | 11/1880 | Schaefer | 33/3 B |
| 1,568,072 | 1/1926 | Krueger et al. | 33/3 B |
| 1,873,663 | 8/1932 | Pietzuch | 33/3 A |
| 2,822,613 | 2/1958 | Lundberg | 33/3 A |
| 3,613,270 | 10/1971 | Eie | 280/611 |
| 3,966,218 | 6/1976 | Beyl | 280/633 |
| 4,194,387 | 3/1980 | Hofbauer et al. | 73/9 |
| 4,311,321 | 1/1982 | Svoboda | 280/611 |
| 4,336,654 | 6/1982 | Svoboda et al. | 33/3 A |

FOREIGN PATENT DOCUMENTS

| | | | |
|---|---|---|---|
| 2240751 | 3/1975 | France | 280/611 |
| 0207146 | 2/1984 | German Democratic Rep. | 33/3 R |
| 0673262 | 7/1979 | U.S.S.R. | 33/3 R |
| 0847981 | 7/1981 | U.S.S.R. | 33/3 R |

*Primary Examiner*—Allan N. Shoap
*Assistant Examiner*—Thomas B. Will
*Attorney, Agent, or Firm*—Finnegan, Henderson, Farabow, Garrett & Dunner

[57] ABSTRACT

A sole measuring device, more particularly for soles of ski boots, having a rail which is attached to a stationary stop for the sole, on which rail there is slidably mounted a slide provided with another stop or which is formed as such. In such a device, provision is made according to the invention that both stops (4, 20) have marks which correspond to an acceptable minimum distance of the upper edge (11) of the sole (10) from its bearing face and to an acceptable maximum distance of the lower edge of the sole (10) from its bearing face. In this way, ski boots that can be used in conjunction with certain ski bindings can be sorted out in very simple fashion from those that are no longer suitable for this purpose.

6 Claims, 3 Drawing Sheets

SOLE MEASURING DEVICE

BACKGROUND OF THE INVENTION

The invention relates to a sole measuring device for footwear, and more particularly to a ski boot sole having a rail attached to a stationary stop for the sole, on which there is slidably mounted a slide provided with another stop.

Sole measuring devices provided with a measuring ruler are known in the art and enable the length of a ski boot sole to be determined, as is necessary, for example, for mounting a binding on a ski.

However, when mounting and adjusting the binding of a ski for downhill skiing, it is also necessary with many modern ski bindings that the ski boot sole meet certain standards in order to ensure appropriate function between ski boot and binding. For example, essential standards concern the minimum height of the upper edge of the sole above its bearing face and the maximum distance of the lower edge of the sole in the area of the heel and the size of the bearing face, which measurements vary as a result of wear on the sole or due to manufacturing variables.

SUMMARY OF THE INVENTION

A primary object of the invention is to provide a sole measuring device which enables one to assess in a simple way whether a ski boot complies with certain standards and whether a given boot is compatible with a given ski binding.

According to the invention, this object is achieved by providing a slidable stop and a stationary stop with marks which correspond to certain dimensional minimums or maximums. For example, the device can check an acceptable minimum distance of the upper edge of the sole from its bearing face and to an acceptable maximum distance of the lower edge of the sole from its bearing face. These marks permit a quick and simple check of, for example, whether the sole of a ski boot has a shape that permits a correct and reliable cooperation with a ski binding. For this purpose, one need only place the ski boot to be tested in the sole measuring device and bring the slidable stop to bear against the sole, with the second end of the sole abutting against the stationary stop. Thus, one can determine in simple fashion whether the sole has an adequate height and whether wear in the front and rear underside surfaces of the sole is within established or acceptable tolerances.

According to another aspect of the invention, provision may be made that marks are formed either from test edges which extend in parallel with the plane of the rail and which delimit a recess that has been cut from the upper side of the corresponding stop into the latter, the recess preferably being provided in the central area of the stop, or by boundaries of the corresponding stop which extend in parallel with the plane of the rail.

The configuration of the present invention makes possible, in a very simple way, a quick and reliable reading of the test result. Thus, one can determine quickly whether a sole is still higher than the corresponding edge and whether the lower edge of a sole lies beneath or above the corresponding edge of the sole measuring device.

In a preferred embodiment of the invention, provision may be made that pairs of marks corresponding to several, or different, sole sizes be provided or formed on the stops. Thus, for example, appropriate marks for soles of ski boots for children and for soles of ski boots for adults may be provided or formed. In this way, one can check all the soles with a single sole measuring device. Advantageously, the marks are formed as test edges that delimit the corresponding recesses of the stops.

Provision may also be made that the test edges be formed in a vertical rear wall of the stop for the heel area of the ski boot, thereby producing a very advantageous arrangement of the test edges serving as marks.

Provision may also be made for measurements of sole width, curvature of the boot toe area above the boot toe ledge, or other areas of the ski boot which may interface with a given binding. Additionally, interchangeable stops could be used to define critical dimensions for various binding designs.

These and other objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

The accompanying drawings, which are incorporated in and constitute a part of this specification, illustrate one embodiment of the invention and, together with the description, serve to explain the principles of the invention.

DETAILED DESCRIPTION OF THE PREFERRED EMBODIMENT

Reference will now be made in detail to the present preferred embodiment of the invention, an example of which is illustrated in the accompanying drawings.

Figure 1:
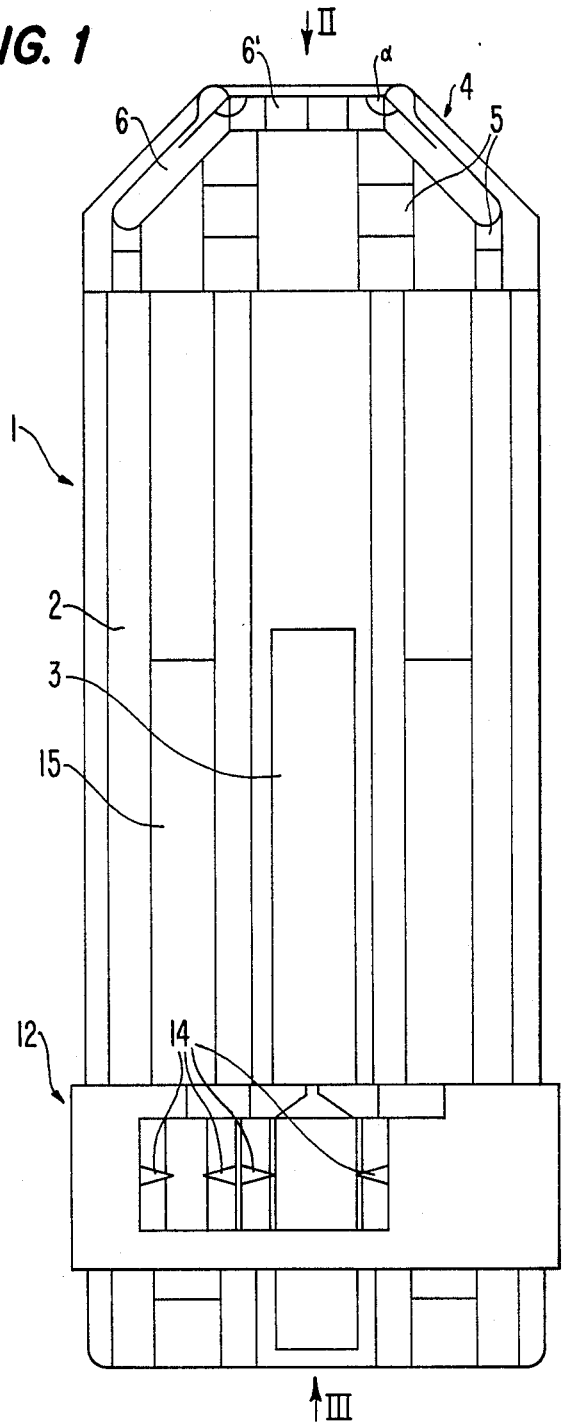
FIG. 1 shows a measuring device incorporating the teachings of the invention.

Referring to FIG. 1, there is provided a sole measuring device 1 having a contoured rail 2 and a central area provided with a metric scale 3.

In one of its terminal areas, rail 2 is attached to a stationary stop 4, which is provided for locating the heel area of a ski boot to be tested.

At the bottom of stop 4, ribs 5 are provided to bring the inserted ski boot to a position corresponding to that in a binding. From the bottom of stop 4, vertical side walls 6 and a vertical rear wall 6' project, which surround the heel area of the ski boot substantially in the shape of U. Each side wall 6 forms an obtuse angle with rear wall 6'.

Figure 2:
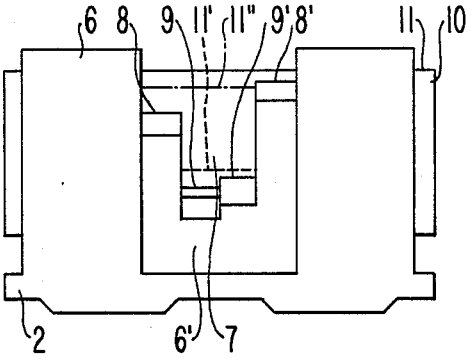
FIG. 2 is a view of the measuring device shown in FIG. 1 in the direction of arrow II in FIG. 1.
Figure 4:
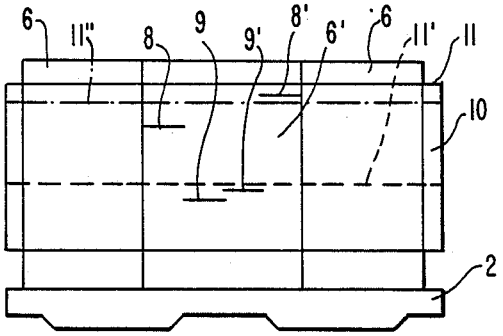
FIG. 4 is a second view of the measuring device shown in FIG. 1 in the direction of arrow II in FIG. 1.

As shown in FIGS. 2 and 4, there is cut into rear wall 6' a recess 7 which starts at its upper end and is delimited at the sides by side walls 6 and at the bottom by test edges 8, 9, 8', 9'. Test edges 8' and 9' are provided for soles of ski boots for adults and test edges 8, 9 for soles of ski boots for children. Thus, associated test edges 8' and 9' or 8 and 9 form marks combined into pairs for ski boots for adults or for children.

FIGS. 2 and 4 also illustrate an upper edge 11 of a ski sole 10. It can be seen that upper edge 11 of ski sole 10 exceeds the minimum height marked by test edge 8' and also falls below the maximum wear distance, established by test edge 9', from the sole bearing plane, so that this sole complies with relevant specifications for use with a given ski binding.

The lower edge of a sole with an unduly worn-down heel is indicated with a dot-dash line 11', so that the lower edge of the sole is an unduly large distance from its bearing plane and can therefore no longer satisfy standards for use with a given ski binding, or which would result in compromised binding system function.

Dot-dash line 11'' indicates a sole with an unduly low height, since here test edge 8' projects over the upper edge of the sole. Such a sole also can produce problems if used with a given ski binding, so that ski boots with such soles should also not be used.

As is apparent from FIGS. 2 and 4, rear wall 6' in the area of the testing edges is chamfered outwardly, so that test edges 8, 9, 8', 9' are formed by the inner surface of rear wall 6'.

As shown further in FIG. 1, there is slidably mounted on rail 2 a slide 12 having two windows on its upper side, on whose edges extending in parallel with the longitudinal direction of rail 2 there are provided marking arrows 14. Arrows 14 cooperate with metric scale 3 and with another scale 15 to determine set length values for rental ski bindings. Such slides 12 are known in themselves and do not constitute the subject matter of the invention.

Figure 3:
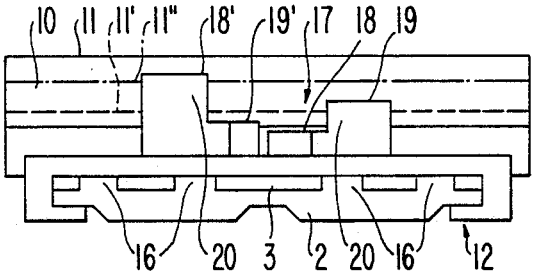
FIG. 3 is a view of a movable stop provided in the measuring device shown in FIG. 1 in the direction of the arrow III in FIG. 1.
Figure 5:
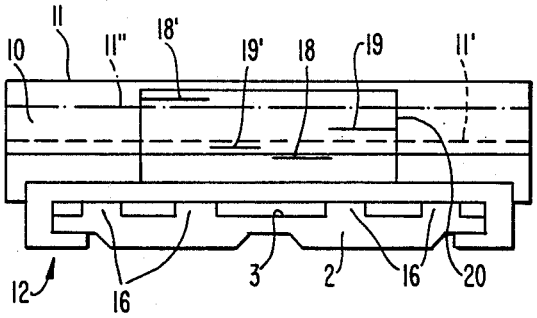
FIG. 5 is a second view of the measuring device shown in FIG. 1 in the direction of the arrow III of FIG. 1.

As shown in FIGS. 3 and 5, slide 12 clasps around rail 2 and rests on raised portions 16 provided in rail 2. Slide 12 is provided with a split stop 20 which extends at right angles to the plane of the slide and which can be brought to bear against one end of the inserted sole. Split stop 20 is provided with test edges 18, 19, 18', 19' which serve as marks combined into pairs and are formed by horizontal boundaries of the stop. Test edges 18, 19 are provided for soles of ski boots for children and test edges 18', 19 for soles of ski boots for adults.

However, it would in theory also be possible to make split stop 20 of one piece and the test edges as boundaries of a recess 17 out from the upper side into split stop 20, as shown in the case of stationary stop 4.

FIGS. 3 and 5 show a sole 10 with a chamfer in the toe area, whereby the solid line 11 shows a sole that complies with specifications for a given ski binding, dotted line 11' indicates a sole with an unduly worn-down toe area and dot-dash line 11'' illustrates a sole with an unduly low height.

Instead of the test edges, the marks may also be formed by dash marks, for example. All that is necessary is to form the rear wall 6' of stationary stop 4 and stop 20 from a translucent or transparent material. As a result, with sole measuring device 1 one can easily determine whether the sole of a ski boot is suitable for proper cooperation with a ski binding.

Additional advantages and modifications will readily occur to those skilled in the art. The invention in its broader aspects is, therefore, not limited to the specific details, representative apparatus and illustrative method shown and described. Accordingly, departures may be made from such details without departing from the spirit or scope of applicants' generic inventive concept as set forth in the appended claims.

What is claimed is:

1. A sole measuring device comprising:

a rail (2) attached to a first stop (4);

a slide slidably mounted on said rail and provided with a second stop, said first and second stops (4, 20) each having marks corresponding to a minimum distance of an upper edge of a sole (10) from a bearing face of the sole and to a maximum distance of the lower edge of the sole (10) from said bearing face.

2. A sole measuring device as set forth in claim 1, wherein said marks are formed from test edges (8, 9; 8', 9'; 18, 19; 18', 19') extending in parallel with a plane of the rail, said test edges delimiting a recess cut into an upper side of said first stop (4), said recess (7) preferably being provided in a central area of said first stop (4).

3. A sole measuring device as set forth in claim 1, wherein said marks are formed from boundaries of said second stop (20) extending in parallel with a plane of the rail (2).

4. A measuring device as set forth in claim 1, wherein pairs of marks corresponding to different sole sizes are formed on said first and second stops (4, 20).

5. A sole measuring device as set forth in claim 2, wherein the test edges (8, 9; 8', 9') are formed in a vertical rear wall (6') of said first stop (4).

6. A sole measuring device as set forth in claim 1, wherein said marks comprise dash marks arranged in translucent or transparent areas of said first and second stops (4, 20).

* * * * *